US009375723B2

(12) United States Patent
Breja

(10) Patent No.: US 9,375,723 B2
(45) Date of Patent: Jun. 28, 2016

(54) CUTTER ASSEMBLY AND ADJUSTABLE CUTTER FOR USE IN COMMINUTING APPARATUS

(71) Applicant: Vermeer Manufacturing Company, Pella, IA (US)

(72) Inventor: Joseph Edward Breja, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 465 days.

(21) Appl. No.: 13/872,801

(22) Filed: Apr. 29, 2013

(65) Prior Publication Data

US 2014/0319260 A1 Oct. 30, 2014

(51) Int. Cl.
*B02C 18/18* (2006.01)

(52) U.S. Cl.
CPC ..... *B02C 18/186* (2013.01)

(58) Field of Classification Search
CPC .... B02C 13/2804; B02C 18/186; B02C 18/18
USPC ..... 241/242, 243, 286, 294
See application file for complete search history.

(56) References Cited

U.S. PATENT DOCUMENTS

| | | | |
|---|---|---|---|
| 3,378,053 | A | 4/1968 | Potzsch |
| 3,854,511 | A | 12/1974 | Maier |
| 3,882,582 | A | 5/1975 | Williams |
| 3,907,016 | A | 9/1975 | Nicholson et al. |
| 3,981,337 | A | 9/1976 | Sundstrom |
| 4,009,837 | A | 3/1977 | Schnyder |
| 4,194,545 | A | 3/1980 | Kostermeier |
| 4,295,616 | A | 10/1981 | Hill |
| 4,390,132 | A | 6/1983 | Hutson et al. |
| 4,449,556 | A | 5/1984 | Colton |
| 4,669,516 | A | 6/1987 | Carpenter et al. |
| 4,848,977 | A | 7/1989 | Kieninger |
| 4,850,406 | A | 7/1989 | Krautzberger |
| 4,984,614 | A | 1/1991 | Landers et al. |
| 5,005,620 | A | 4/1991 | Morey |
| 5,209,278 | A | 5/1993 | Carpenter et al. |
| 5,271,442 | A | 12/1993 | Carpenter et al. |
| 5,274,899 | A | 1/1994 | Sentagnes et al. |
| 5,439,039 | A | 8/1995 | Bradstreet, Jr. et al. |
| 5,485,873 | A | 1/1996 | Crammond |
| 5,819,825 | A | 10/1998 | Lyman et al. |
| 6,293,481 | B1 | 9/2001 | Ragnarsson |
| 6,688,351 | B2 | 2/2004 | Stager et al. |
| 6,772,810 | B1 | 8/2004 | Bouchard et al. |
| 7,069,969 | B2 | 7/2006 | Knappett et al. |
| 7,798,186 | B2 | 9/2010 | Stager |
| 8,033,308 | B2 | 10/2011 | Stager |

(Continued)

FOREIGN PATENT DOCUMENTS

| | | |
|---|---|---|
| AT | 006264 U1 | 7/2003 |
| CA | 2239752 | 6/1998 |

(Continued)

*Primary Examiner* — Mark Rosenbaum
(74) *Attorney, Agent, or Firm* — Armstrong Teasdale LLP

(57) ABSTRACT

A cutter for use with a comminuting apparatus includes a body, a body slot, and a bore hole. The body has first and second opposing surfaces, a first edge adjoining the first and second surfaces, and a cutting edge opposite the first edge. The body extends from the cutting edge to the first edge. The body slot extends through the cutter body from the first surface to the second surface. The bore hole is enclosed by the first and second surfaces, and extends from the body slot to the first edge.

17 Claims, 12 Drawing Sheets

(56) References Cited

U.S. PATENT DOCUMENTS

| | | | |
|---|---|---|---|
| 8,061,640 | B2 | 11/2011 | Cotter et al. |
| 8,113,453 | B2 | 2/2012 | Bardos |
| 8,167,013 | B2 | 5/2012 | D'Ignazio et al. |
| 8,281,826 | B2 | 10/2012 | Uelmen et al. |
| 2003/0222163 | A1 | 12/2003 | Plahuta et al. |
| 2009/0242677 | A1 | 10/2009 | Smidt et al. |

FOREIGN PATENT DOCUMENTS

| | | | |
|---|---|---|---|
| CA | 2498241 | | 3/2004 |
| DE | 2353371 | A1 | 11/1974 |
| DE | 20009718 | U1 | 10/2000 |
| DE | 202005013719 | U1 | 4/2006 |
| DE | 102006004464 | A1 | 9/2006 |
| DE | 102011012663 | A1 | 8/2012 |
| WO | 2007130193 | A1 | 11/2007 |

CUTTER ASSEMBLY AND ADJUSTABLE CUTTER FOR USE IN COMMINUTING APPARATUS

CO-PENDING, CO-OWNED APPLICATIONS INCORPORATED HEREIN

The present application incorporates U.S. application Ser. No. 13/872,737, filed Apr. 29, 2013, entitled Adjustable Anvil for Comminuting Apparatus and U.S. application Ser. No. 13/872,876, filed Apr. 29, 2013 entitled Mounting Block for Attaching a Reducing Element to a Rotary Drum, herein by reference for all relevant and consistent purposes.

FIELD OF THE DISCLOSURE

The field of the disclosure relates generally to cutting assemblies used in comminuting apparatus and, more specifically, to adjustable cutting elements secured by adjustable fasteners.

BACKGROUND

Comminuting apparatus such as grinders and chippers are used to mechanically grind, chip or shred material to reduce the size of the material. Such apparatus may be used to reduce the size of arboraceous material, such as tree limbs, stumps or brush, or other material (e.g., building materials, fibrous organic or inorganic materials, etc.) in land-clearing, municipal waste, recycling, repurposing, and composting operations. One common type of reducing machine is known as a horizontal grinder. A horizontal grinder may include a power in-feed mechanism that forces larger material (e.g., wood-based material such as tree trunks, tree branches, logs, etc.) into contact with a rotating comminuting drum. The larger material is contacted by reducing elements, such as teeth, grinding elements, or "knives", carried by the comminuting drum, and portions of the material are forced past a shear edge defined by an anvil of the horizontal grinder.

Upon passing the shear edge of the anvil, the material enters a chamber, which in the case of a horizontal grinder may be defined at least in part by a sizing screen that extends around a portion of the comminuting drum. Within the chamber, the material is further reduced by the reducing elements carried by the comminuting drum. Once the material within the chamber is reduced to a certain particle size, the material is ultimately discharged from the machine. An example of a horizontal grinder is disclosed in US Patent Publication No. 2009/0242677, which is incorporated herein by reference for all relevant and consistent purposes.

Conventional comminuting apparatus generally rely on clamps to secure the knives within the comminuting drum. In operation, the loading experienced by the reducing elements may cause the reducing elements to slip out of the comminuting drum and contact the anvil, resulting in a catastrophic failure. Some comminuting apparatus use serrations or grooves to limit such problems. However, such apparatus restrict a user's ability to adjust and/or maintain a given bite size of the comminuting apparatus through the wear life of a given reducing element, as serrations and grooves only permit incremental adjustment of the length of the knives. Further, such apparatus can require complex and costly manufacturing processes.

A continuing need exists for a comminuting apparatus that adequately secures cutting elements and allows the bite size of a comminuting apparatus to be easily maintained through a reducing element wear cycle by adjustment of the cutting elements.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a cutter for use with a comminuting apparatus is provided. The cutter includes a body, a body slot, and a bore hole. The body has first and second opposing surfaces, a first edge adjoining the first and second surfaces, and a cutting edge opposite the first edge. The body extends from the cutting edge to the first edge. The body slot extends through the cutter body from the first surface to the second surface. The bore hole is enclosed by the first and second surfaces, and extends from the body slot to the first edge.

In another aspect, a cutter assembly for use with a comminuting apparatus is provided. The assembly includes a cutter, a first fastener, and a second fastener. The cutter includes a body, a body slot, and a bore hole. The body has first and second opposing surfaces, a first edge adjoining the first and second surfaces, and a cutting edge opposite the first edge. The body extends from the cutting edge to the first edge. The body slot extends through the cutter body from the first surface to the second surface. The bore hole extends within the cutter body from the body slot towards the first edge. The first fastener extends through the body slot of the cutter and is configured to secure the cutter to a rotatable drum. The second fastener extends through the bore hole and into the body slot.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
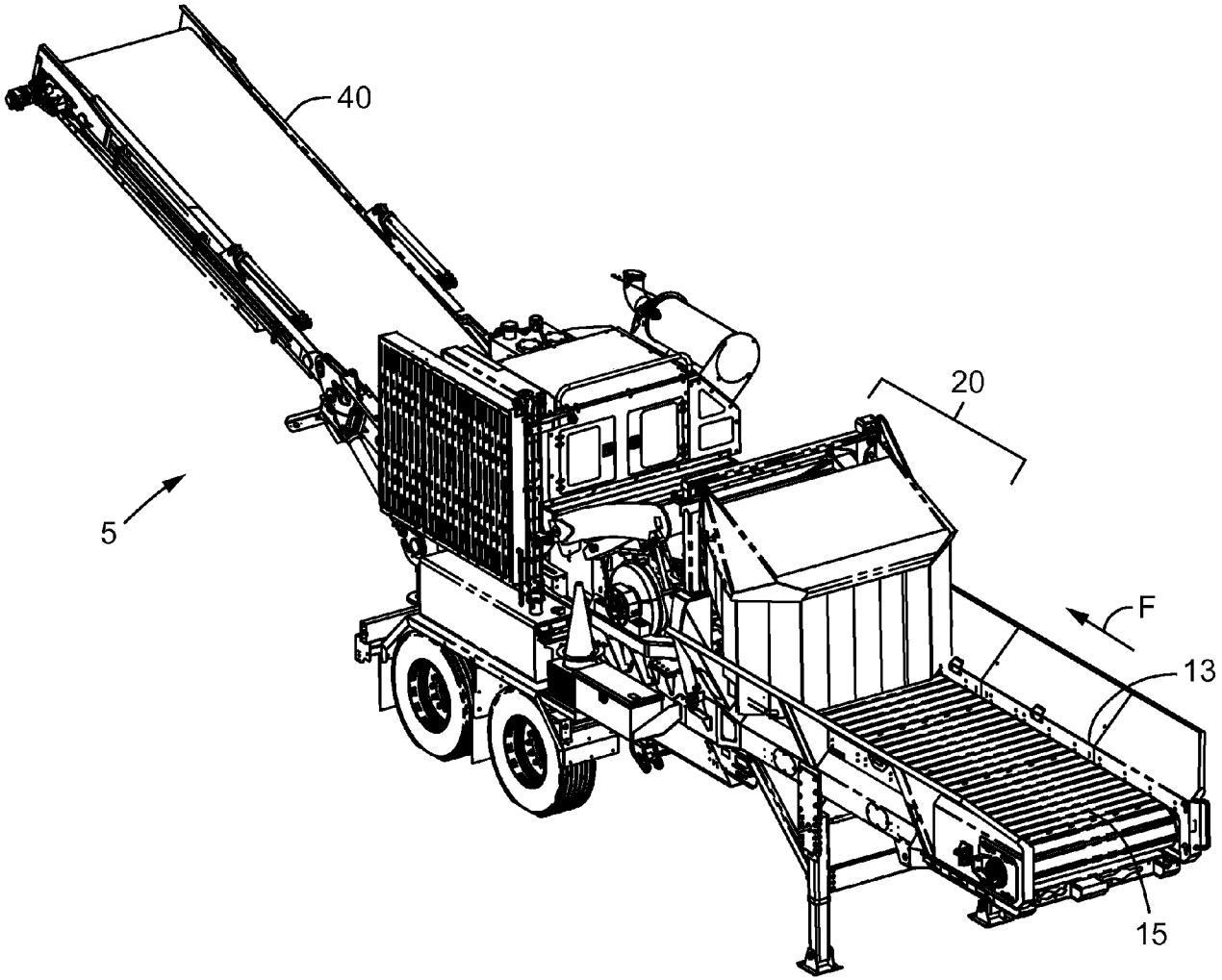
FIG. 1 is a perspective view of a comminuting apparatus.

An embodiment of a comminuting apparatus for reducing the size of material is generally indicated at 5 in FIG. 1. The apparatus 5 is depicted as a horizontal grinder having a power in-feed system 13, a comminuting assembly 20 and a discharge conveyor 40. While the embodiments herein are described with reference to a horizontal grinder, this disclosure may also apply to other types of apparatus for comminuting material, such as a wood chipper having a chute for discharging comminuted material.

Figure 2:
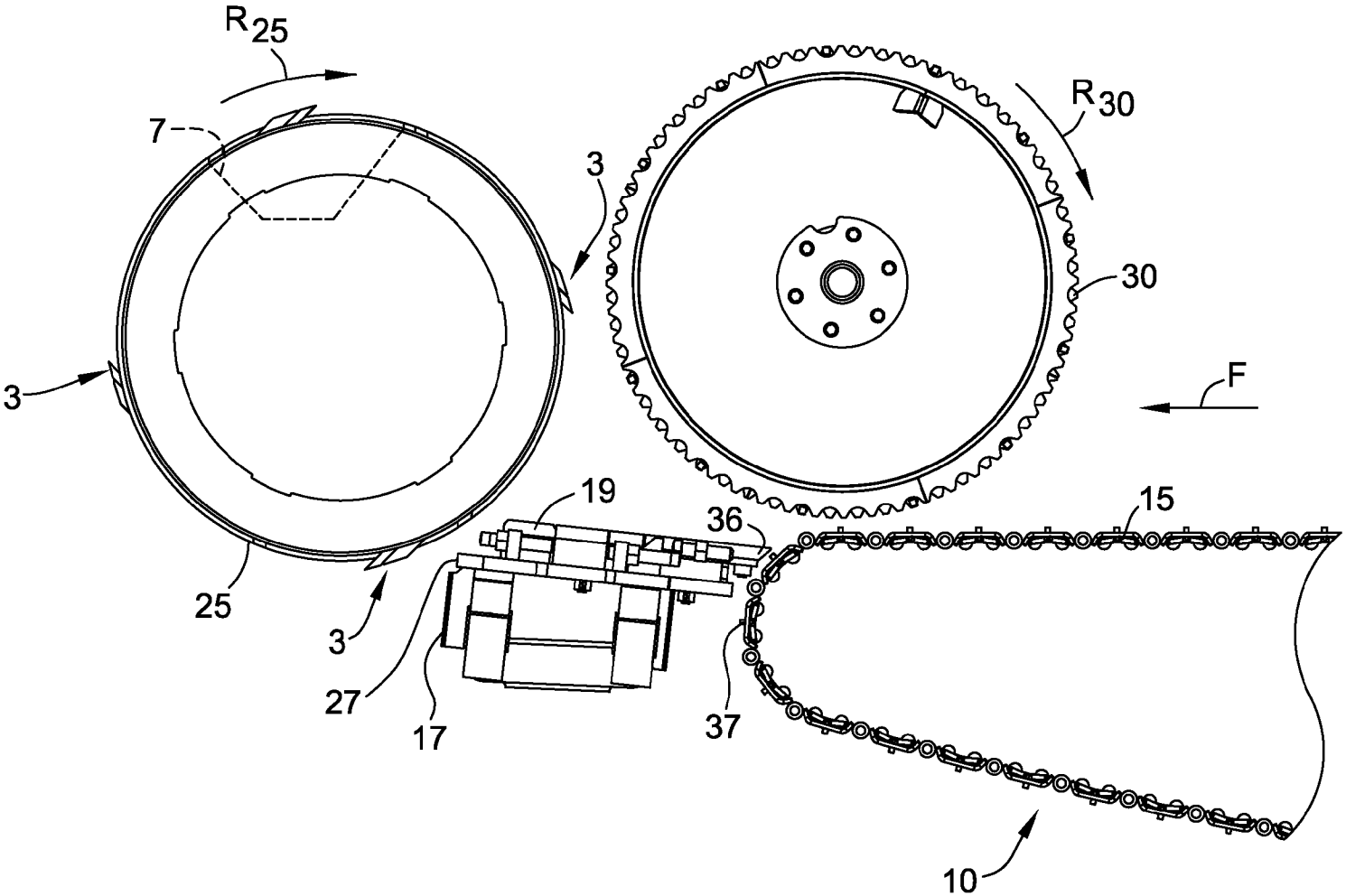
FIG. 2 is a side view of the in-feed system, anvil, feed roller and comminuting drum of the apparatus of FIG. 1.

The in-feed system 13 of the comminuting apparatus 5 includes an endless conveyor (e.g., a belt, a chain drive, etc.) 15 to move the material toward a comminuting drum 25 (FIG. 2) in a feed direction indicated by arrow F. As shown in FIG. 2, the in-feed system has a first end 37 proximal to an anvil 17. The anvil 17 is disposed between the in-feed system 13 and a comminuting drum 25 to bridge the gap between the in-feed system 13 and comminuting drum 25. A feed roller 30 rotates about an axis in direction $R_{30}$ to force material over the anvil 17 and to contact the comminuting drum 25. The anvil 17 includes a first end 27 adjacent the drum 25 and a second end 36 adjacent the in-feed system 13. In alternative embodiments, anvil 17 may be omitted from comminuting apparatus. In such embodiments, the in-feed system 13 may perform similar functions as anvil 17.

The comminuting drum 25 carries a plurality of cutting assemblies 3 (e.g., teeth, blades, knives, grinding elements, etc. and combinations of these elements). During operation, the comminuting drum 25 rotates about an axis of rotation in direction $R_{25}$ such that the tips of the cutting assemblies 3 define a circumferential reducing path 39. The apparatus 5 may also include a sizing screen 10 (e.g., in the case of a horizontal grinder) that at least partially surrounds the comminuting drum 25, but it is understood that such a sizing screen 10 would not necessarily be needed should the comminuting apparatus instead be a chipper. A reducing chamber 35 may be defined in the region proximate the comminuting drum 25 (e.g., between the comminuting drum 25 and the sizing screen 10, in the case of a horizontal grinder).

Figure 3:
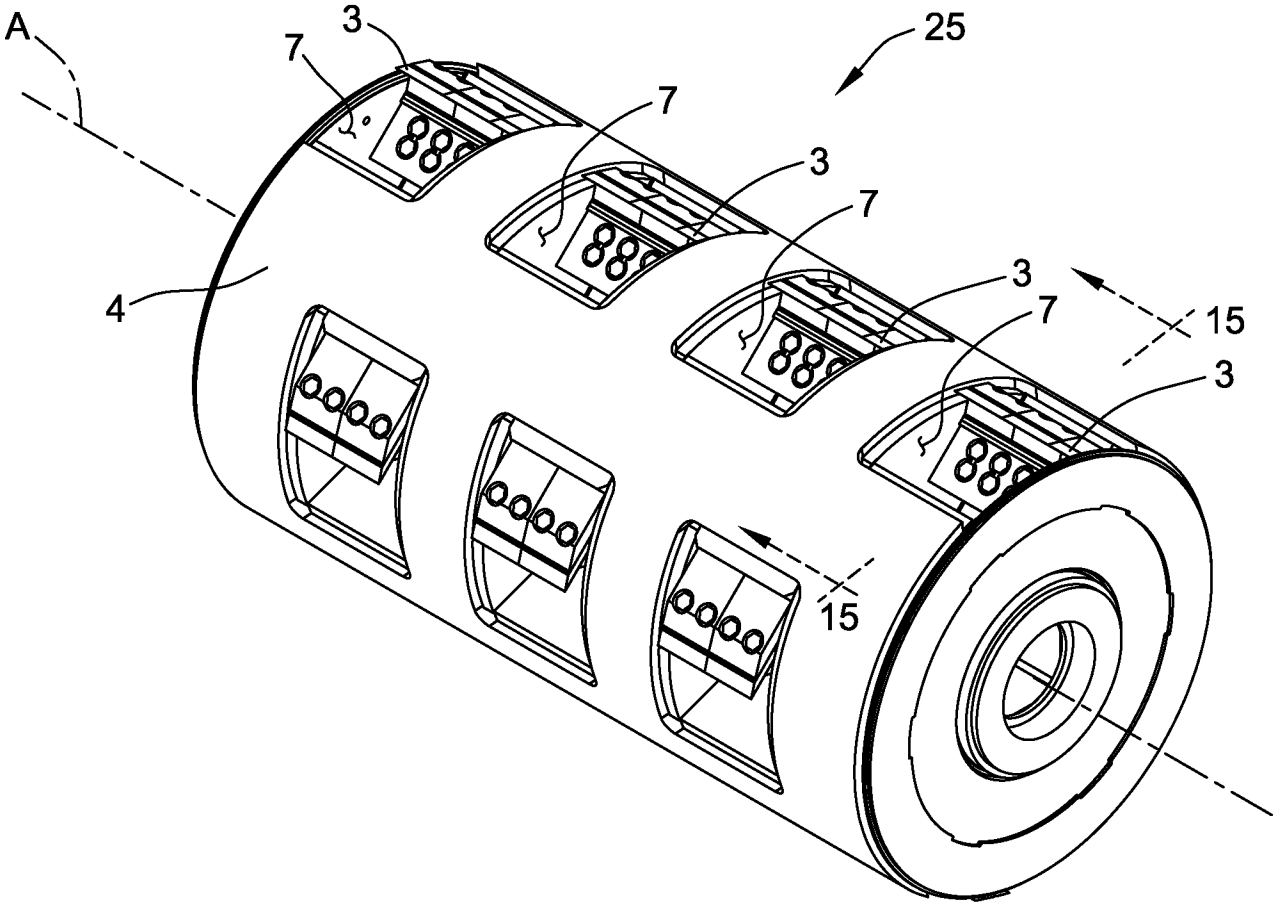
FIG. 3 is a perspective view of the comminuting drum of FIG. 2.

As shown in FIG. 3, the comminuting drum 25 rotates about an axis A. The drum 25 may, for purposes of illustration only, include a shell 4 and several pockets 7 formed in the shell. Alternatively, the drum 25 may, for example, instead include a plurality of rotary plates between which at least one cutting assembly 3 is mounted. In the embodiment shown in FIG. 3, the pockets 7 are arranged in several rows that are parallel to the axis. In alternative embodiments, pockets 7 may be staggered over the circumference of the shell 4, or may be arranged in any suitable pattern that enables apparatus 5 to function as described herein. Each pocket 7 includes a cutting assembly 3 that is mounted within pocket 7 and that partially extends radially from pocket 7 to define a reducing path 39 (shown in FIG. 2) of the comminuting drum 25.

Figure 4:
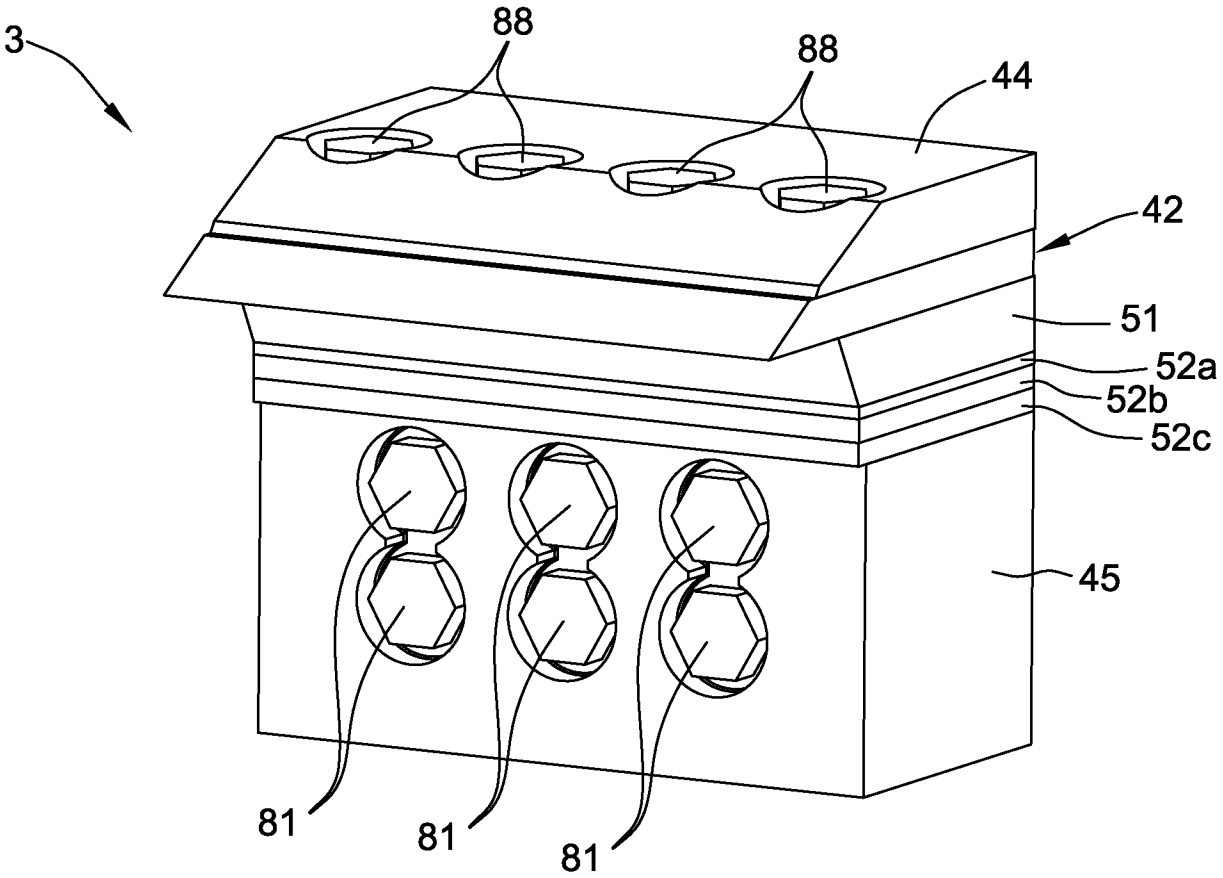
FIG. 4 is a perspective view of the cutting assembly of FIG. 3.
Figure 5:
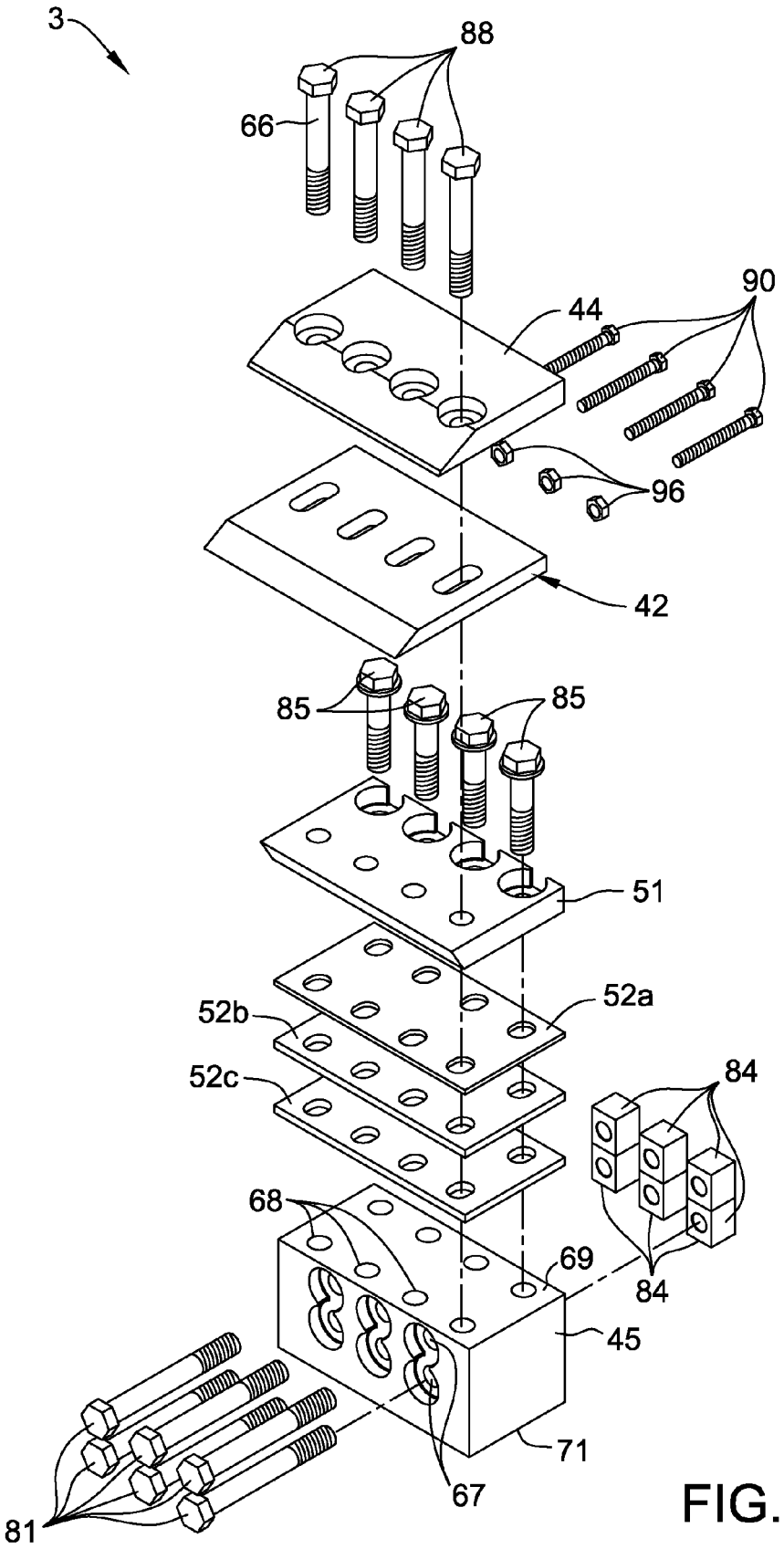
FIG. 5 is an exploded view of the cutting assembly of FIG. 3.
Figure 6:
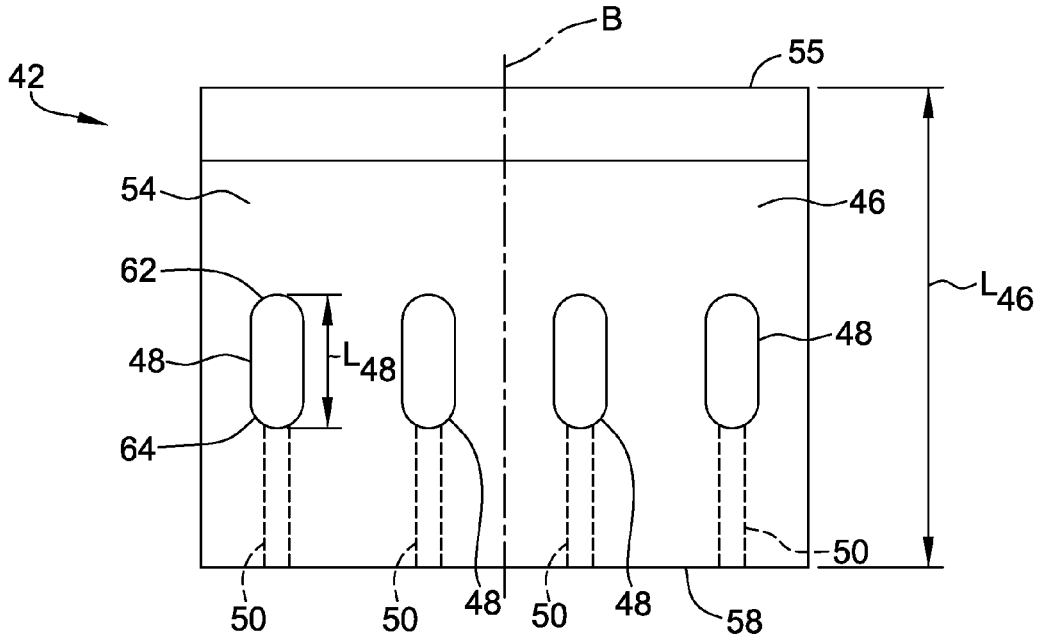
FIG. 6 is a top view of the cutting element of FIG. 4.
Figure 7:
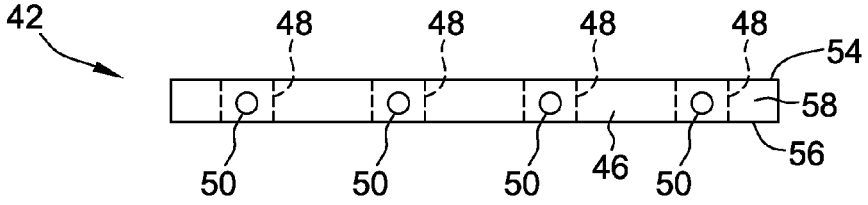
FIG. 7 is a rear view of the cutting element of FIG. 4.
Figure 8:
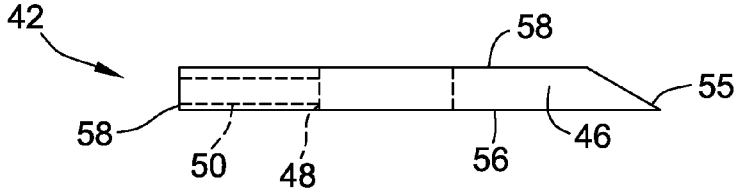
FIG. 8 is a side view of the cutting element of FIG. 4.

Referring now to FIGS. 4-5, each cutting assembly 3 includes a cutting element 42 (e.g., teeth, blades, grinding elements, knives, etc. and combinations thereof) for comminuting and/or reducing (e.g., in terms of size) material; a plurality of first fasteners 88 for securing the cutting element 42 to comminuting drum 25; and a plurality of second fasteners 90 for adjustably positioning the cutting element 42 (particularly the cutting edge 55 thereof, described in more detail below) relative to comminuting drum 25. The first fasteners 88 are substantially perpendicularly aligned to the second fasteners 90 to facilitate adjustment of the cutting element 42 relative to comminuting drum 25.

In the embodiment shown in FIGS. 4-5, cutting assembly 3 also includes a mounting block for coupling the cutting element 42 to the comminuting drum 25, a support plate 51 and a clamping plate 44 to secure cutting element 42, a plurality of third fasteners 85 to secure support plate 51 to mounting block 45, a plurality of fourth fasteners 81 to secure mounting block 45 to a support surface of comminuting drum 25 (e.g., the surface 60 of pocket 7 shown in FIG. 15), and a plurality of spacers 52*a*, 52*b*, 52*c*. In the embodiment shown in FIGS. 4-5, the fourth fasteners 81 are aligned substantially parallel to the second fasteners 90 and substantially perpendicular to the first fasteners 88. The embodiment shown in FIGS. 4-5 includes three spacers, although alternative embodiments may include more or fewer spacers, such as one, two, four, five, or zero spacers.

In alternative embodiments, one or more of mounting block 45, third fasteners 85, fourth fasteners 81, support plate 51, clamping plate 44, and spacers 52*a*, 52*b*, and 52*c* may be omitted from cutting assembly 3. In embodiments where mounting block 45 is omitted from cutting assembly, cutting element 42 may be secured directly to comminuting drum 25 via first fasteners 88, as described below.

In the embodiment shown in FIGS. 4-5, cutting element 42 is disposed between support plate 51 and clamping plate 44. Spacers 52*a*, 52*b*, and 52*c* may be used to adjust the distance between cutting element 42 and mounting block 45 and thereby used to adjust the achievable bite size. In the embodiment shown in FIGS. 4-5, the mounting block 45 is configured to receive a single cutting element 42. In alternative embodiments, mounting block 45 may be configured to receive two cutting elements, three cutting elements, four cutting elements, or any other suitable number of cutting elements that enables the comminuting apparatus 5 to function as described herein.

Referring now to FIGS. 6-10, cutting element 42 includes a body 46, at least one body slot 48 configured to receive a first fastener 88, and at least one bore hole 50 configured to receive a second fastener 90. In the embodiment shown in FIGS. 6-10, cutting element 42 includes four body slots 48 and four bore holes 50. In alternative embodiments, cutting element 42 may have any suitable number of body slots 48 and/or bore holes 50 that enable apparatus 5 to function as described herein.

The cutting-element body 46 includes first and second opposing surfaces 54 and 56, a first edge 58 adjoining the first and second surfaces 54 and 56, and a cutting edge 55 opposite the first edge 58. Cutting edge 55 is configured to contact and comminute material to be reduced to an appropriate size. It is to be understood that the cutting edge 55 may be in the form of shear edge, a grinding edge, or other surface that facilitates the cutting and/or size reduction of a material being processed and/or recycled. Also, it is to be further understood that the cutting edge 55 may, for example, be a single continuous edge, be defined via a series of teeth (not shown), or have any other suitable configuration that enables comminuting apparatus 5 to function as described herein. The cutting-element body 46 extends a length $L_{46}$ from cutting edge 55 to first edge 58 along an orientation B (shown in FIG. 6). In the embodiment shown in FIGS. 6-10, cutting-element body 46 is made of A8 tool steel. In alternative embodiments, cutting-element body 46 may be made from any suitable material that enables apparatus 5 to function as described herein, such as wear-resistant alloys (e.g., hardened steel); ceramics (e.g., tungsten carbide, silicon nitride, silicon carbide); or composite materials (e.g., hard-faced steel, where hard-facing may include a carbide/ceramic interspersed in a metal matrix material).

Body slots 48 extend through cutting-element body 46 from first surface 54 to second surface 56. Body slots 48 also extend a length $L_{48}$ in the direction of orientation B. In the embodiment shown in FIGS. 6-10, each body slot 48 has substantially the same length $L_{48}$, and each body slot 48 is oriented in a direction substantially perpendicular to cutting edge 55, especially when the cutting edge 55 is a shear edge. Such an orientation helps maintain an essentially consistent bite size across cutting edge 55 when the cutting-element body 46 is moved in relation to the first fasteners 88 extending through the body slots 48.

Body slots 48 include opposing first and second ends 62 and 64. First and second ends 62 and 64 are sized and shaped complementary to an outer peripheral surface 66 of first fasteners 88. First and second ends 62 and 64 are configured to engage first fasteners 88 so as to restrict movement of cutting element 42 along orientation B. In the embodiment shown in FIGS. 6-10, first and second ends 62 and 64 have a generally circular shape with a radius of curvature substantially equal to a radius of curvature of first fasteners 88. Each body slot 48 therefore has a generally oblong shape. In alternative embodiments, one or more body slots 48 may have a rectangular, elliptical, or polygonal shape, or any other suitable shape that enables comminuting apparatus 5 to function as described herein.

Each body slot 48 corresponds to a bore hole 50 extending from the second end 64 of a respective body slot 48 towards first edge 58 of cutting-element body 46. Each bore hole 50 is configured to receive and engage a second fastener 90. Bore holes 50 are enclosed by first and second surfaces 54 and 56, and are completely defined within cutting-element body 46. In the embodiment shown in FIGS. 6-10, each bore hole 50 is threaded so as to engage threads on second fasteners 90 when second fasteners 90 are secured to cutting element 42 as part of the cutting assembly 42. In alternative embodiments, bore holes 50 may include any other suitable alternative and/or additional means to engage second fasteners 90 that enable apparatus 5 to function as described herein.

Bore holes 50 are sized and shaped complementary to an outer peripheral surface of second fasteners 90. In the embodiment shown in FIGS. 6-10, each bore hole 50 has a generally circular cross section with a diameter substantially equal to the diameter of a corresponding second fastener 90. In alternative embodiments, the size and/or shape of bore holes 50 may vary based upon the size and shape of the corresponding second fasteners 90.

Figure 9:
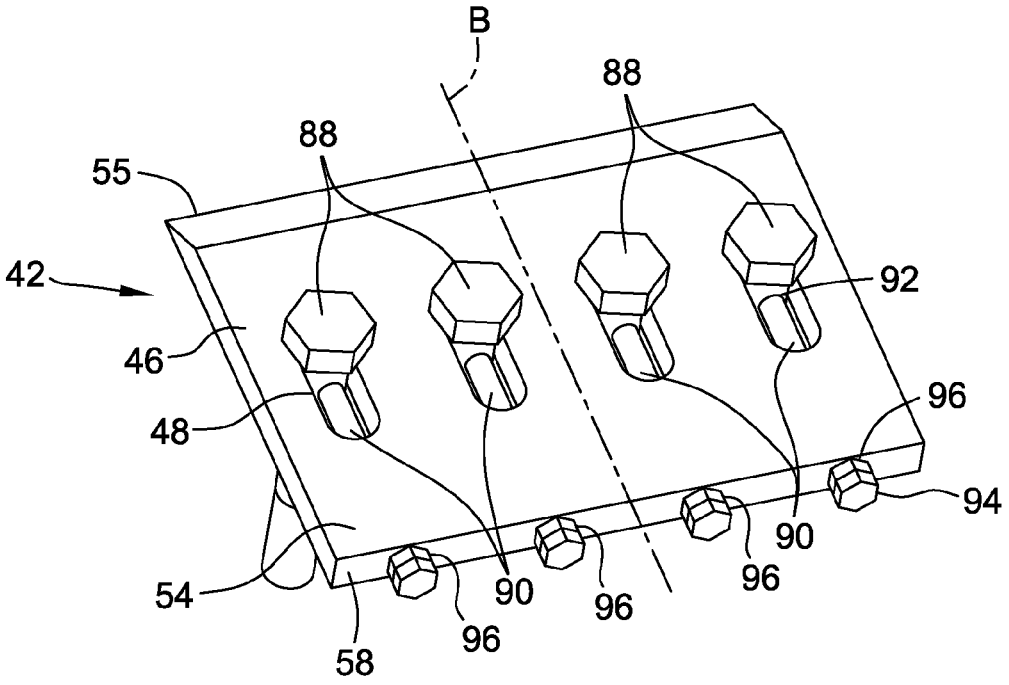
FIG. 9 is a perspective view of the cutting element, first fasteners and second fasteners of FIG. 4.
Figure 10:
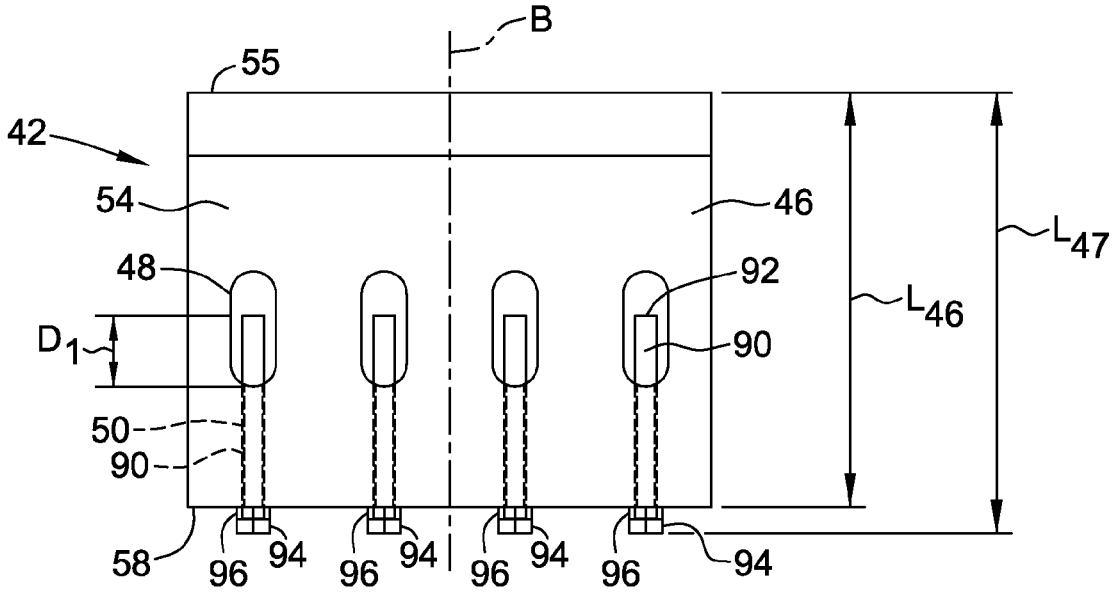
FIG. 10 is a top view of the cutting element and second fasteners shown in FIG. 9.
Figure 11:
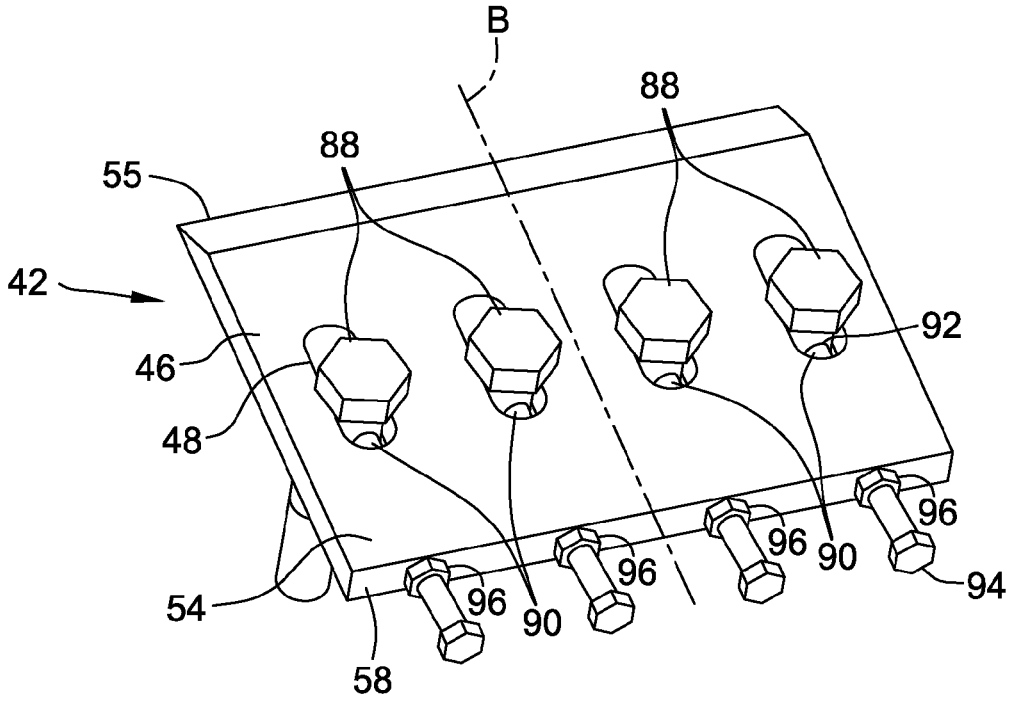
FIG. 11 is a perspective view of the cutting element, first fasteners and second fasteners shown in FIG. 9, in an alternate position.
Figure 12:
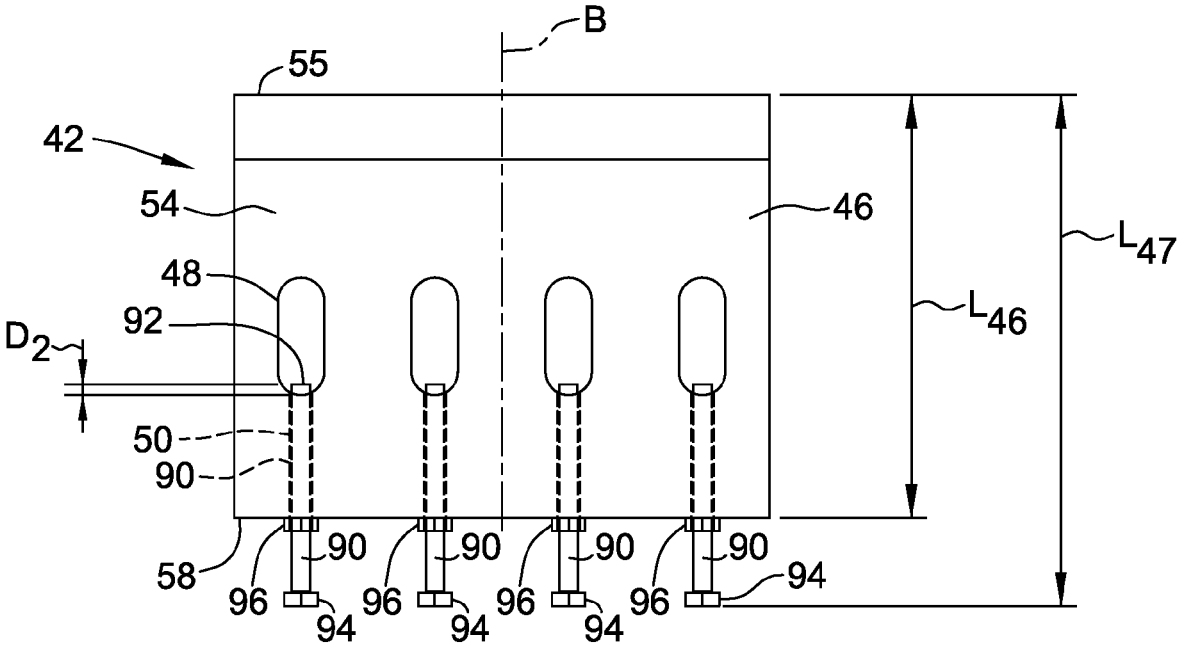
FIG. 12 is a top view of the cutting element and second fasteners shown in FIG. 11.
Figure 13:
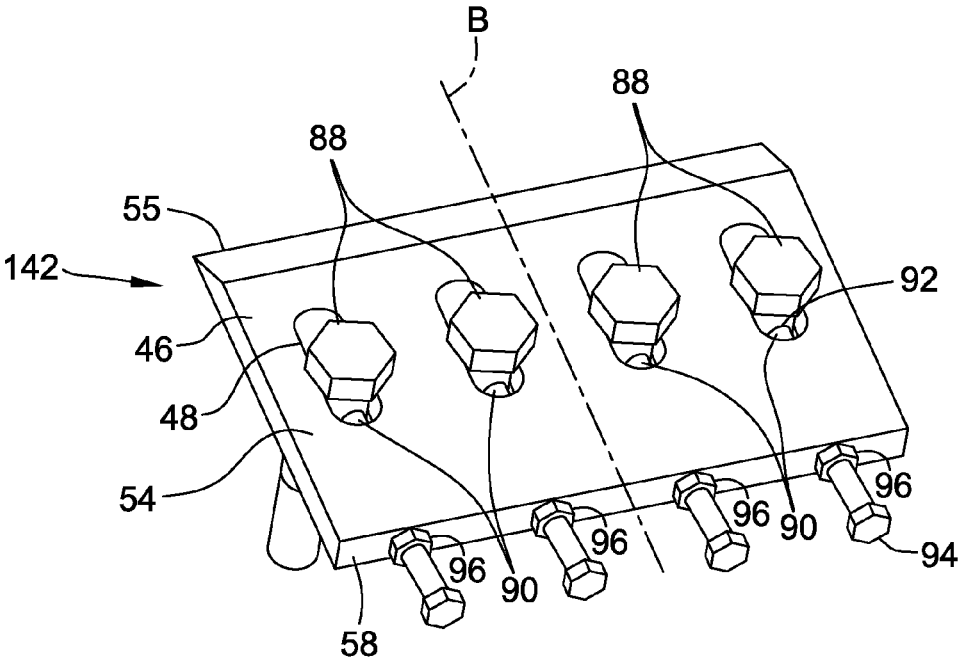
FIG. 13 is a perspective view of a sharpened cutting element having a reduced length, and first fasteners and second fasteners shown in FIG. 9.
Figure 14:
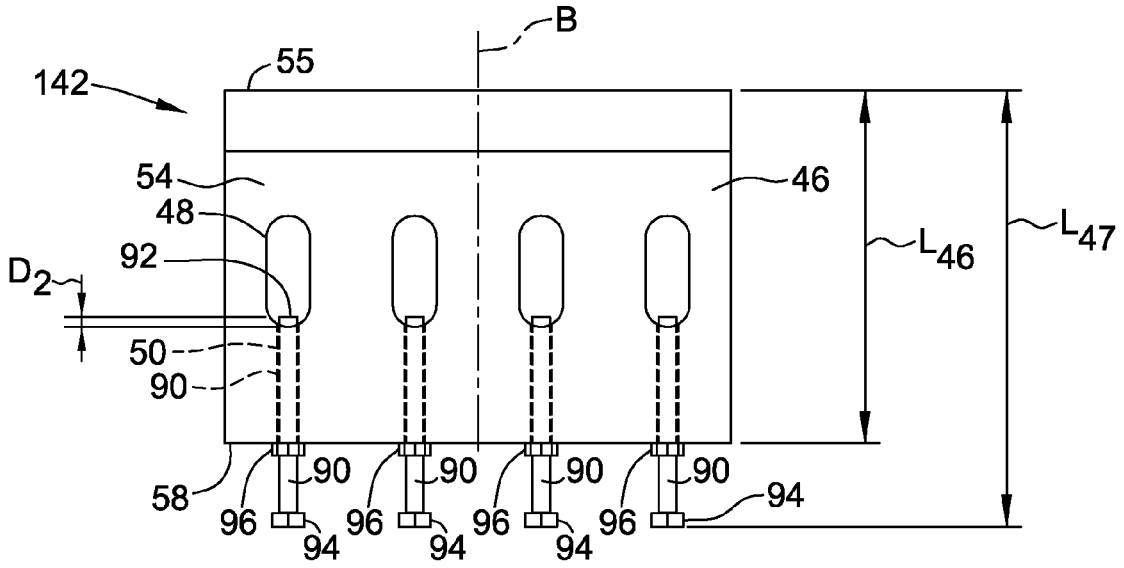
FIG. 14 is a top view of the sharpened cutting element and second fasteners shown in FIG. 13.

Referring now to FIGS. 5 and 9-10, cutting element 42 is secured to mounting block 45 via first fasteners 88. Mounting block 45 includes through holes 68 that extend through mounting block 45 from a top surface 69 of mounting block 45 to a bottom surface 71 of mounting block 45. As shown in FIG. 5, first fasteners 88 extend through a corresponding body slot 48 in cutting element 42 and into a corresponding through-hole 68 in mounting block 45. In the embodiment shown in FIGS. 4-5, first fasteners 88 also extend through corresponding through holes in clamping plate 44, support plate 51 and spacers 52*a*, 52*b*, and 52*c*, thereby securing clamping plate 44, support plate 51 and spacers 52*a*, 52*b*, and 52*c* to mounting block 45.

Mounting block 45 is secured to comminuting drum 25 via fourth fasteners 81. Each fourth fastener 81 extends through a corresponding through-hole 67 on mounting block 45, and into a corresponding through-hole (not shown) on comminuting drum 25. A lock nut 84, in the illustrated example, is used to secure fourth fastener 81 and mounting block 45 to comminuting drum 25. Alternatively, for example, the comminuting drum 25 may have threaded holes (not shown) associated therewith to permit the attachment of a given fourth fastener 81.

In alternative embodiments, cutting element 42 may be secured directly to comminuting drum 25 via first fasteners 88. In such embodiments, first fasteners 88 may extend through a corresponding body slot 48 of cutting element 42, and into a corresponding through-hole (not shown) on comminuting drum 25. First fasteners may be secured to comminuting drum using a lock nut similar to lock nut 84. Alternatively, comminuting drum 25 may have threaded holes (not shown) associated therewith to permit the attachment of a given first fastener 88.

Figure 15:
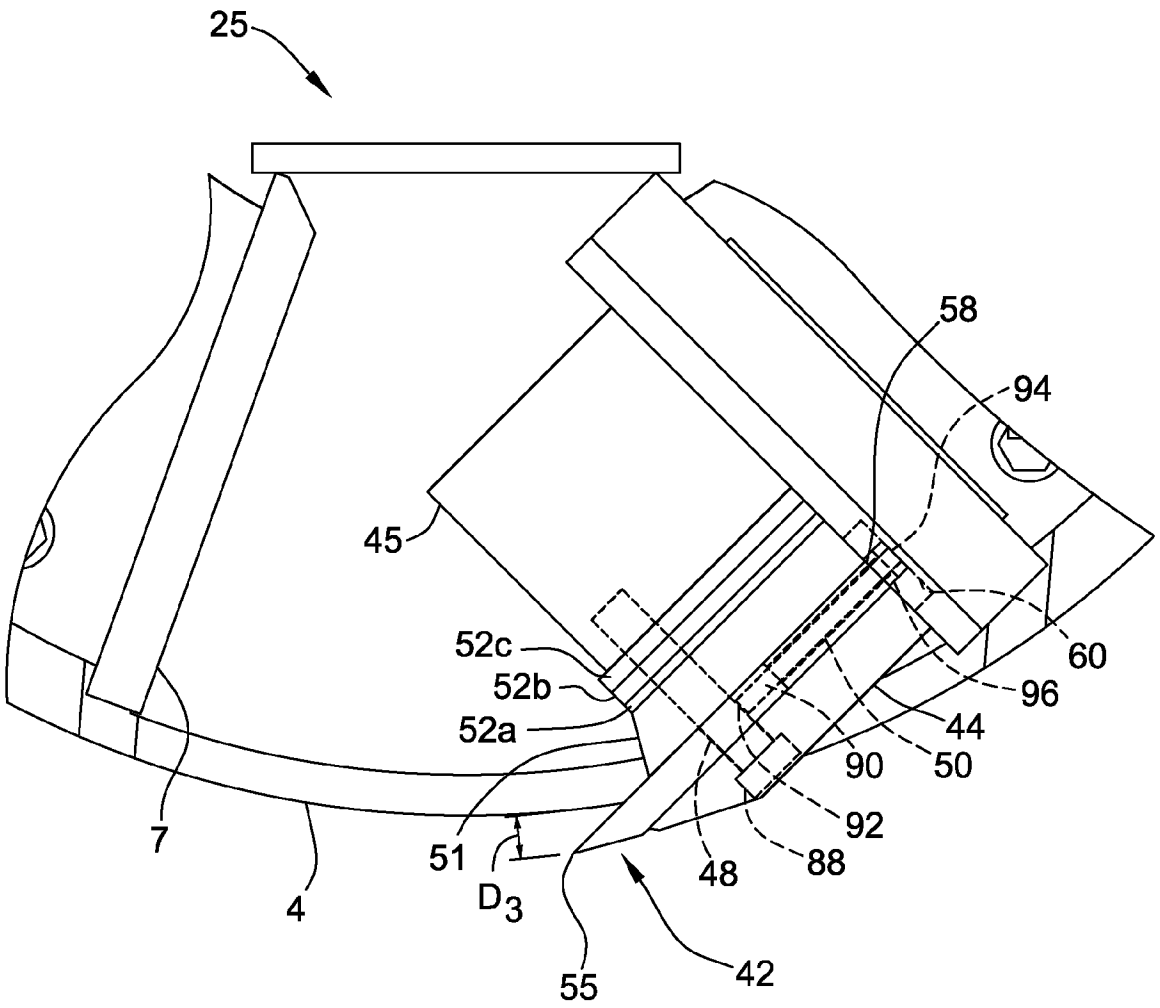
FIG. 15 is a side view of the comminuting drum with the cutting element in a first position.
Figure 16:
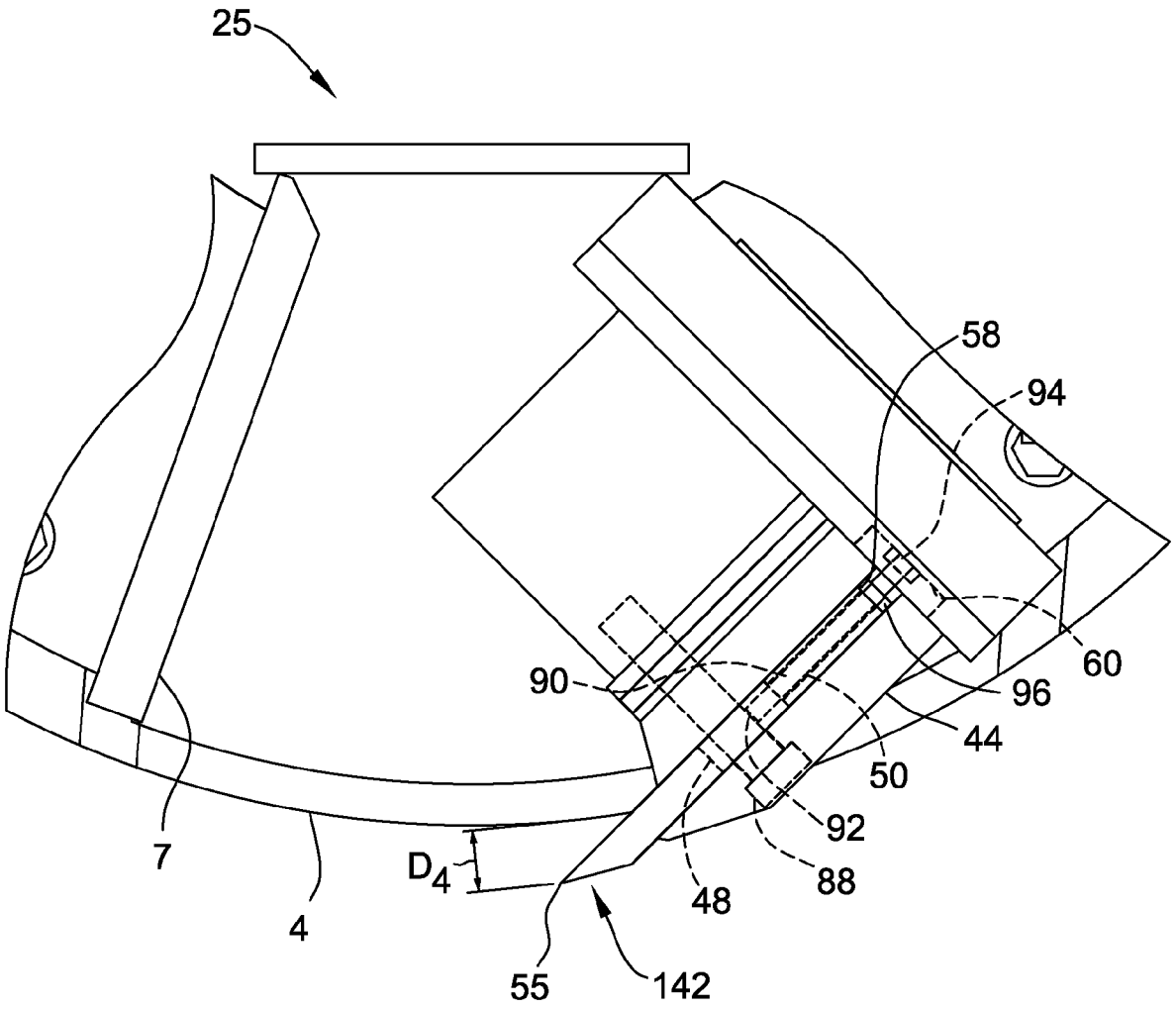
FIG. 16 is a side view of the comminuting drum with the cutting element in a second position.
Figure 17:
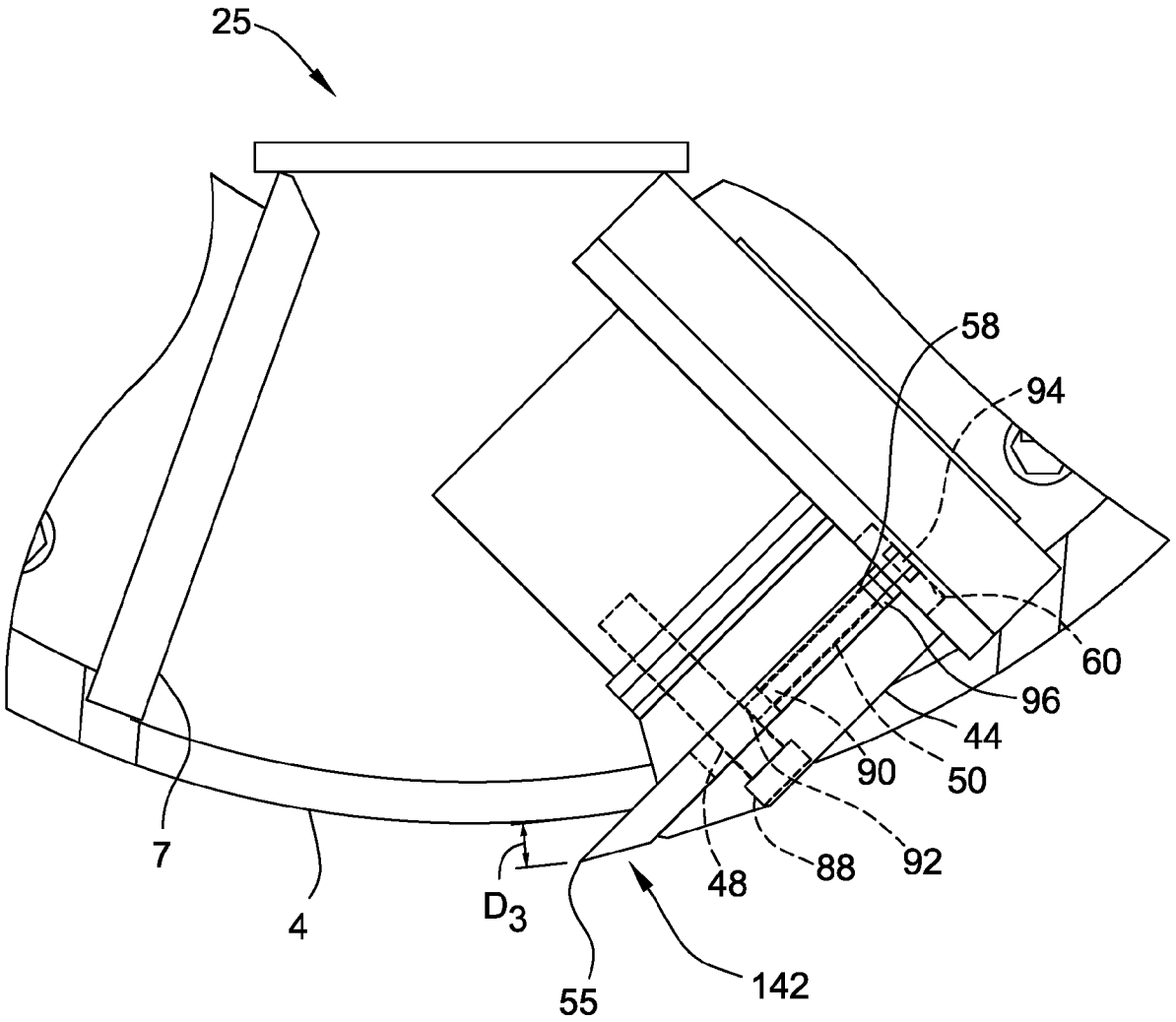
FIG. 17 is a side view of the comminuting drum with the sharpened cutting element in a third position.

Second fasteners 90 extend through a corresponding bore hole 50 in cutting element 42, and into the body slot 48 corresponding to the bore hole 50. Second fasteners 90 may extend into body slots 48 a distance $D_1$ (shown in FIG. 10). Each second fastener 90 includes a first end 92 configured to engage one of first fasteners 88, and a second end 94 configured to engage a surface associated with the comminuting drum 25 (e.g., a surface 60 within the pocket 7, as shown in FIG. 15). When assembled (shown in FIG. 4), each second fastener 90 is secured to cutting element 42 so as to restrict movement of second fasteners 90 with respect to a corresponding first fastener 88, and with respect to the comminuting drum 25.

In the embodiment shown in FIGS. 4-5 and 9-10, second fasteners 90 are secured to cutting element 42 via a threaded engagement between threads on second fasteners 90 and threads within each bore hole 50. Additional securing means may be used to further restrict movement between cutting element 42 and second fasteners 90.

For example, in the embodiment shown in FIGS. 4-5 and 9-10, the cutting assembly 3 includes a plurality of lock nuts 96 wherein each lock nut 96 corresponds to a second fastener 90. Lock nuts 96 are secured to second fasteners 90 and positioned adjacent first edge 58 of cutting element 42, thereby restricting movement between second fasteners 90 and cutting element 42. Lock nuts 96 facilitate maintaining a specific spacing between the surface 60 of the comminuting drum 25 and the first edge 58 and/or between the second end 94 of the corresponding second fastener and the first edge 58. Similarly, the lock nuts 96 lock in the distance between the first edge 58 and the corresponding first end 92 of the respective second fastener 90. Accordingly, the lock nuts 96 can be used to help maintain a desired bite size and/or distance between a given first fastener 90 and the cutting edge 55, even as the cutting element 42 is sharpened and concordantly shortened. In the embodiment shown in FIGS. 4-5 and 9-10, each lock nut 96 is a jam nut, although any suitable type of lock nut may be used that enables comminuting drum 25 to function as described herein.

Alternatively, instead of using the lock nuts 96 with the second fasteners 90, two different fastener sets (not expressly shown) may be employed. A first set of fasteners (e.g., second fasteners 90) may be employed to maintain a distance between comminuting drum 25 and first fasteners 88. A second set of fasteners (not shown) may be employed to maintain a distance between first edge 58 of cutting element 42 and first fasteners 88.

In yet other alternative embodiments, bore holes 50 may be unthreaded, and two or more lock nuts may be used to secure second fasteners 90 to cutting element 42. For example, a first lock nut 96 may be secured to the portion of second fastener 90 extending into body slot 48. A second lock nut 96 may be secured to second fastener 90 adjacent the first edge 58 of cutting element 42.

Each second end 94 of second fasteners 90 engages a surface 60 (shown in FIG. 15) associated with comminuting drum 25 facing first edge 58 of cutting element 42. In the embodiment shown in FIG. 15, surface 60 is within pocket 7. Each first (i.e., free) end 92 of second fasteners 90 is configured to engage a corresponding first fastener 88 extending through body slot 48 in cutting element 42. Initially, first end 92 of second fastener 90 may be separated from first fastener 88 by a nominal gap (not shown) to facilitate assembly of the cutting assembly 3. First end 92 of second fastener 90 is thus proximate first fastener 88 when initially assembled. During operation, if cutting element 42 begins to slide out of comminuting drum 25, first end 92 of second fastener 90 will engage a corresponding first fastener 88 and prevent cutting element 42 form sliding outwardly with respect to comminuting drum 25. Additionally, as cutting element 42 comminutes feed material, the engagement between second (i.e., head) end 94 of second fasteners 90 and surface 60 prevents cutting element 42 from being pushed inwardly into comminuting drum 25.

The distance that second fasteners 90 extend into body slots 48 may be adjusted based upon a desired distance between the cutting edge 55 of cutting element 42 and the second end 94 of second fastener, hereinafter referred to as the "effective length" $L_{47}$ of the cutting element 42. Similarly, the distance that second fasteners 90 extend into body slots 48 may be adjusted based upon a desired distance $D_3$ (shown in FIG. 15) between cutting edge 55 of cutting element 42 and shell 4 of comminuting drum 25, commonly referred to as the "bite" size of the comminuting apparatus 5.

For example, to account for a decrease in the length $L_{46}$ of cutting-element body 46 following sharpening of cutting element 42, the distance $D_1$ that second fasteners 90 extend into body slots 50 may be adjusted to maintain a constant effective length $L_{47}$ of the cutting element 42 and/or to maintain a constant distance $D_3$ between cutting edge 55 of cutting element and shell 4 of comminuting drum 25, thereby maintaining a constant bite size of comminuting drum 25. Referring to FIGS. 9-10, 13-15, and 17, an unsharpened cutting element 42 has an effective length $L_{47}$, and the cutting edge 55 of unsharpened cutting element 42 is at a distance $D_3$ from shell 4 of comminuting drum 25. To maintain a constant effective length $L_{47}$ and a constant distance $D_3$ (i.e., bite size) between a cutting edge 55 of a sharpened cutting element 142 (shown in FIGS. 13-14) and shell 4 of comminuting drum 25, the distance $D_1$ that second fasteners 90 extend into body slots 50 may be decreased to a distance $D_2$ compared to the unsharpened cutting element 42. As a result, a constant effective length $L_{47}$ and a constant bite size of comminuting drum 25 can be maintained even as the length $L_{46}$ of cutting-element body 46 decreases due to sharpening or wear. The configuration of the cutting assembly 3 thus permits the second fasteners 90 to prevent cutting element 42 from sliding out of comminuting drum 25, and also to maintain a constant effective length and bite size as the overall length of cutting element 42 is reduced due to wear and sharpening.

Alternatively, the bite size of comminuting drum 25 and the effective length $L_{47}$ of cutting element 42 may be varied for a desired application. For example, as shown in FIGS. 9-12 and 15-16, by decreasing the distance $D_1$ to a lesser distance $D_2$ (shown in FIG. 12), the effective length $L_{47}$ may be increased, and the distance $D_3$ between cutting edge 55 of cutting element and shell 4 of comminuting drum may be increased to a greater distance $D_4$ (shown in FIG. 16). As a result, the bite size of the comminuting drum 25 is increased. As set forth in greater detail in co-pending, co-assigned U.S. patent application Ser. No. 13/872,876entitled Mounting Block for Attaching a Reducing Element to a Rotary Drum, filed on Apr. 29, 2013 (the contents of which are hereby incorporated by reference thereto), the positioning of the mounting block 45 and the use of one or more spacers 52*a-c* may, alternatively or additionally, be used to achieve the desired bite size.

In accordance with embodiments of the present disclosure, a constant effective length of the cutting element and/or a constant bite size of a comminuting drum may be maintained after sharpening one or more cutting elements by adjusting the position of one or more fasteners extending through a corresponding bore hole in a cutting element. Alternatively, the effective length of a cutting element and the bite size of a comminuting drum may be varied by adjusting the position of one or more fasteners extending through a corresponding bore hole in a cutting element. The fasteners used to adjust the position of the cutting element may be used to securely fasten the cutting element within the comminuting drum, and to prevent the cutting element from sliding into or out of the comminuting drum during operation.

The embodiments described herein provide several advantages over conventional apparatus used for comminuting material. For example, the fasteners used to adjust the effective length and the bite size of the comminuting apparatus also function to securely fasten the cutting element within the comminuting drum, and prevent the cutting element from sliding into or out of the comminuting drum during operation. The fasteners also provide a continuous adjustment path (as opposed to an incremental adjustment path resulting from serrations or grooves), and also prevent failure that might otherwise result from cutting elements sliding out of comminuting drum during operation. Accordingly, the user may vary the effective length of the cutting element, as well as the bite size of the comminuting drum, to vary performance of the apparatus or to off-set a decrease in the overall length of cutting element resulting from wear or sharpening.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements.

The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawings shall be interpreted as illustrative and not in a limiting sense.

What is claimed is:

1. A cutter and fastener for use with a comminuting apparatus, the cutter comprising:

a body having first and second opposing surfaces, a first edge extending from the first surface to the second surface, and a cutting edge opposite the first edge, the cutter body extending from the cutting edge to the first edge;

a body slot extending through the cutter body from the first surface to the second surface; and a bore hole enclosed by the first and second surfaces, the bore hole extending from the body slot to the first edge;

the fastener extending through the bore hole and into the body slot, a locking nut being coupled to the fastener and being adjacent to the first edge of the cutter to prevent movement of the fastener.

2. The cutter and fastener as set forth in claim 1, wherein the body slot is oriented in a direction substantially perpendicular to the cutting edge.

3. The cutter and fastener as set forth in claim 1, wherein the bore hole is threaded.

4. The cutter and fastener as set forth in claim 1, wherein the body slot includes first and second opposing ends, and the bore hole extends from the second end of the body slot to the first edge.

5. The cutter and fastener as set forth in claim 4, wherein the first and second ends of the body slot are shaped complementary to an outer peripheral surface of a fastener.

6. The cutter and fastener as set forth in claim 5 wherein the first and second ends the body slot have a generally arcuate shape.

7. A cutter assembly for use with a comminuting apparatus, the assembly comprising:

a cutter including:

a body having first and second opposing surfaces, a first edge extending from the first surface to the second surface, and a cutting edge opposite the first edge, the cutter body extending from the cutting edge to the first edge;

a body slot extending through the cutter body from the first surface to the second surface; and a bore hole extending within the cutter body from the body slot towards the first edge;

a first fastener extending through the body slot of the cutter and configured to secure the cutter to a rotatable drum; and a second fastener extending through the bore hole and into the body slot, the second fastener including a first end and a second end, the first end engaging the first fastener.

8. The assembly as set forth in claim 7, wherein the second fastener is a threaded fastener.

9. The assembly as set forth in claim 7, further comprising a locking nut coupled to the second fastener, the locking nut configured to prevent movement of the second fastener with respect to the first fastener.

10. The assembly as set forth in claim 9, wherein the locking nut is coupled adjacent to the first edge of the cutter.

11. The assembly as set forth in claim 7, wherein the body slot includes first and second opposing ends, and the bore hole extends from the second end of the body slot to the first edge.

12. The assembly as set forth in claim 11, wherein the first and second ends are shaped complementary to an outer peripheral surface of the first fastener.

13. The assembly as set forth in claim 12, wherein the first and second ends have a generally arcuate shape.

14. The assembly as set forth in claim 7 in combination with a rotatable drum, wherein the cutting assembly is secured to the rotatable drum via first fasteners.

15. The assembly as set forth in claim 14, wherein the rotatable drum includes a pocket defined therein, and wherein the cutter assembly is secured within the pocket.

16. The assembly as set forth in claim 15, wherein the second end of the second fastener abuts the pocket of the rotatable drum.

17. The assembly as set forth in claim 14 wherein the cutter assembly is secured to a mounting block, wherein the mounting block is mounted to the rotatable drum.

* * * * *